US007690933B1

(12) United States Patent
Smith

(10) Patent No.: US 7,690,933 B1
(45) Date of Patent: Apr. 6, 2010

(54) LOADBREAK ELECTRICAL CONNECTOR COVER AND METHOD OF USE FOR PREVENTING ARCING DURING ELECTRICAL SYSTEM REPAIRS

(75) Inventor: Theodore L. Smith, Colman, SD (US)

(73) Assignee: Sioux Valley Energy, Colman, SD (US)

( * ) Notice: Subject to any disclaimer, the term of this patent is extended or adjusted under 35 U.S.C. 154(b) by 0 days.

(21) Appl. No.: 12/411,965

(22) Filed: Mar. 26, 2009

(51) Int. Cl.
*H01R 13/53* (2006.01)

(52) U.S. Cl. ..... 439/181

(58) Field of Classification Search ..... 439/181, 439/367, 445, 532, 534
See application file for complete search history.

(56) References Cited

U.S. PATENT DOCUMENTS 3,900,698 A 8/1975 Yotsugi
5,742,000 A 4/1998 Stevens
6,303,870 B1 10/2001 Nazaryan et al.
7,154,036 B2 12/2006 Lynch
7,617,963 B1 * 11/2009 Jensen ..... 228/44.5
2008/0299818 A1 * 12/2008 Hughes et al. ..... 439/445

* cited by examiner

*Primary Examiner*—Chandrika Prasad
(74) *Attorney, Agent, or Firm*—Briggs and Morgan, P.A.

(57) ABSTRACT

An insulative body adapted to be deformed into contact with a plurality of loadbreak elbow connectors secured to a transformer or other electrical apparatus during repair or replacement, providing safe and secure access for a linesman. The body enshrouds a volume surrounding a plurality of loadbreak elbow connectors with a form-fitting structure adapted to deform into contact with the plurality of loadbreak elbow connectors when an external force is used to place the cover. Collar portions defining retaining structure are adapted to retain the cover in place until an external force is applied to remove the cover.

18 Claims, 6 Drawing Sheets

LOADBREAK ELECTRICAL CONNECTOR COVER AND METHOD OF USE FOR PREVENTING ARCING DURING ELECTRICAL SYSTEM REPAIRS

FIELD OF THE INVENTION

The invention relates to protective barrier structures for electrical connectors particularly in the transmission of electrical power through pad-mounted electrical equipment. More particularly, the invention relates to devices and associated operating procedures for assuring the safety of working personnel when performing repairs upon energized pad-mounted electrical equipment by reducing the risk of accidental arcing and resultant flash-related injuries to personnel and damage to equipment.

BACKGROUND OF THE INVENTION

An electrical distribution system typically includes distribution lines or feeders that extend out from a substation transformer. The substation transformer is typically connected to a generator via electrical transmission lines. Along the path of a feeder, one or more distribution transformers may be provided to further step down the distribution voltage for a commercial or residential customer. The distribution voltage range may be from 5 through 46 kV, for example. Various connectors are used throughout the distribution system. In particular, the primary side of a distribution transformer typically includes a transformer bushing to which a bushing insert is connected. In turn, an elbow connector, for example, may be removably coupled to the bushing insert. The distribution feeder is also fixed to the other end of the elbow connector. Of course, other types of connectors are also used in a typical electrical power distribution system. For example, the connectors may be considered as including other types of removable connectors, as well as fixed splices and terminations. Large commercial users may also have a need for such high voltage connectors.

The prior art includes the use of insulative blankets to protect lineman from active elbow connectors. Clips have been used to temporarily secure the blankets in place. The blankets tend to be large and bulky and typically prevent the lineman from visual access to other portions of the electrical equipment. The blanket may be easily dislodged if the clips are knocked off or otherwise inadvertently removed, resulting in loss of protection for the linemen.

There remains a need for safety devices and associated operating procedures to enable linemen to work inside energized pad-mounted electrical equipment with a substantially reduced risk of creating a flash situation.

SUMMARY OF THE INVENTION

The present invention addresses the above concern for worker safety by providing a specially tailored flash-preventing safety shield that can be readily inserted in place prior to work at the access side of energized electrical equipment. The safety shield takes the form of a preformed electrically insulated cover including locating and securing structure that slides over one or more loadbreak electrical connectors, such as elbows. The securing structure serves to locate the shield in an orientation that protects against flashes and also serves to retain the shield in place, preferably including a friction fit in some areas. In one preferred embodiment, the shield may take a generally inverted L-shape with four depressions to one edge of the shield and with the remaining portion of the shield being of sufficient size to cover the adjacent portions of the elbow connectors at which a flash is most likely to occur. The shield also may include raised portions that provide added protection so that the lineman's tools cannot contact surfaces of most commonly used elbow connectors. In one embodiment, the shield is formed from a resilient material having a thickness sufficient to provide adequate insulative protection for the voltage levels encountered in typical transformers.

BRIEF DESCRIPTION OF THE DRAWINGS

In the accompanying drawings which form part of the specification and wherein like numerals and letters refer to like parts wherever they occur.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

In a residential application, the interior of a transformer includes one side where the transformer windings are encased in oil and a second "access side" where the line connections are made for connecting the wires from the transformer to the several (e.g., 3 to 8) houses being served by the transformer. The transformer side and the access side are separated by a "transformer face" that extends vertically. When a lineman opens a transformer for access, he typically sees three secondary bushings at 120V/240V and two or more primary bushings at a voltage in the range of 7,000V to 25,000, usually about 13,000V. Each of the secondary bushings supports a standard connector at which the wires are connected for running to the houses.

When it becomes necessary to service the transformer (for example, to remove and replace a wire connected to one of the connector bars) it is important that proper safety precautions are used. First, the lineman should wear rubber gloves. Second, the lineman should secure insulative blankets over the connector bars that are not being accessed. At this point, according to prior art practices, the worker is ready to access connector bar bolts and/or elbows for replacement or repair. The worker has to be very careful not to allow conductive tools to contact the transformer face. For example, when a wrench contacts the transformer face, a "flash" situation results. A flash produces a bright light that can damage the worker's eyes, can damage the tools in use, can damage the bushing and can otherwise damage the transformer to the point where it may have to be removed from use.

Figure 1:
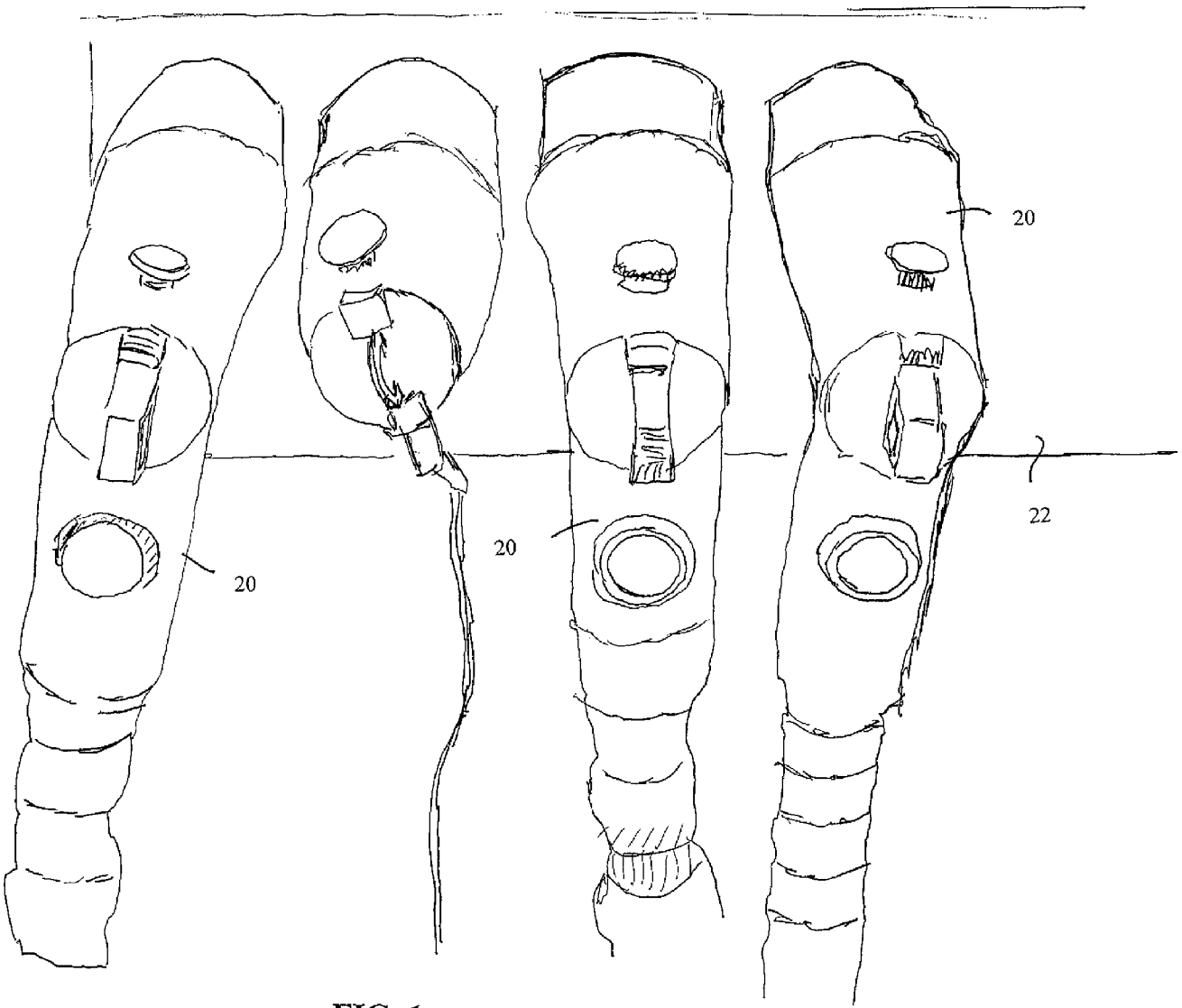
FIG. 1 is a perspective illustration of a transformer and plurality of elbow connectors secured thereto.

FIG. 1 illustrates a plurality of elbow connectors 20 electrically coupled to transformer 22. In this example, transformer 22 includes four terminals with three elbow connectors 20 being shown. Transformer 22 can assume a variety of sizes and shapes and the present invention is not limited to any particular transformer 22 design. One embodiment of electrical elbow connector 20 is initially described. As will be appreciated by those skilled in the art, the elbow connector 20 is but one example of an electrical connector, such as for high voltage power distribution applications, comprising a connector body having first and second intersecting passageways therethrough. That is, the present invention may advantageously be applicable to other connector types (T-shaped, etc.), as well.

Figure 2:
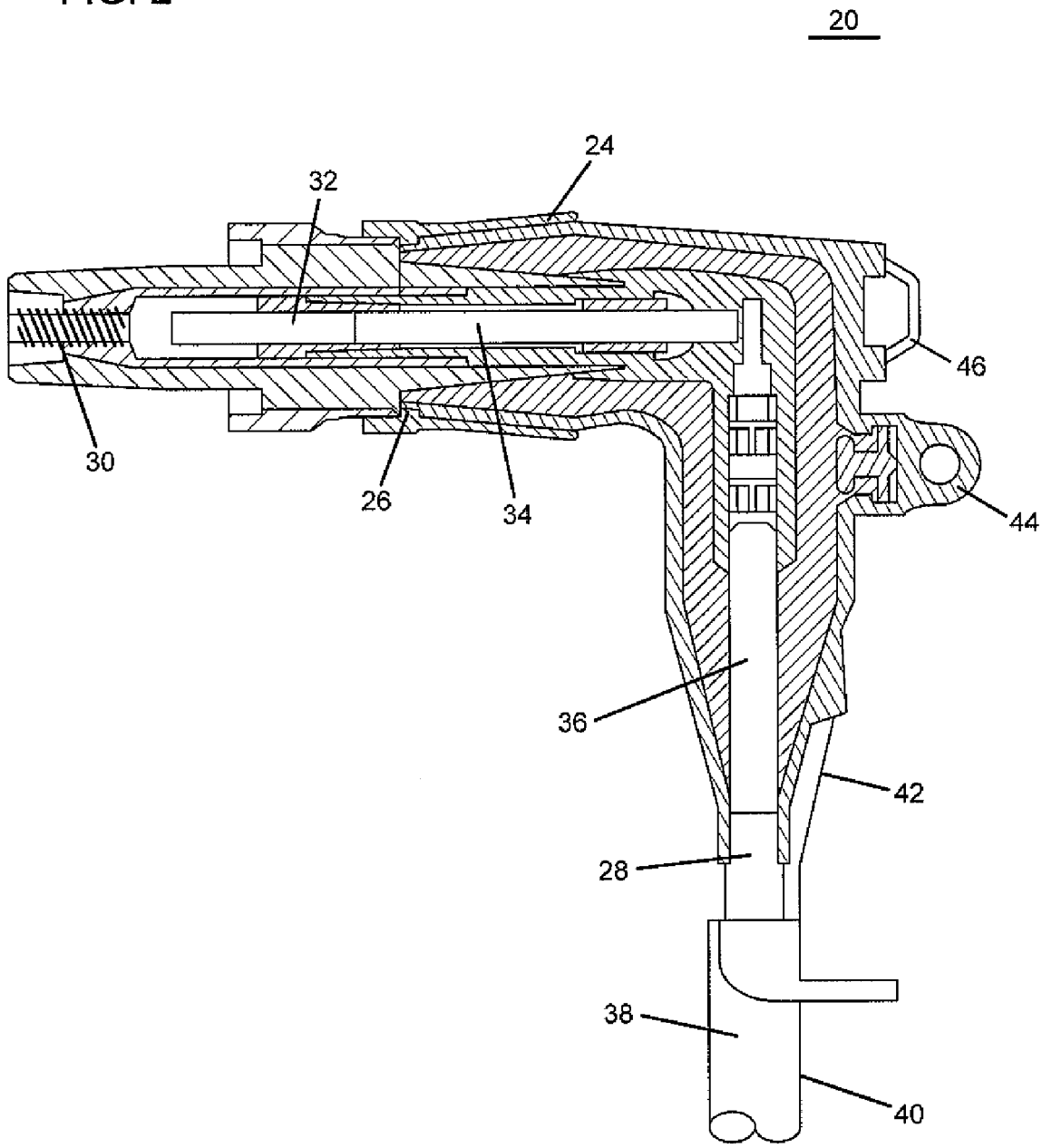
FIG. 2 is a cross-sectional view taken through an elbow connector of the prior art.

Referring to FIG. 2, an electrical elbow connector 20 is initially described. As will be appreciated by those skilled in the art, elbow connector 20 is but one example of an electrical connector, such as for high voltage power distribution applications, comprising a connector body 24 having first and second intersecting passageways 26, 28 therethrough. Elbow connector 20 includes a conductive bushing stud 30 conductively coupled via probe tip 32, probe 34 and conductor 36 to conductor 38 within insulated cable 40. Connector body 24 defines an insulating layer that covers the electrically conductive components of elbow 20. Elbow connector 20 also includes ground wire 42, capacitive voltage cap 44 and pulling eye 46. Body 24 comprise one or more electrically insulative layers as described below.

Figure 3:
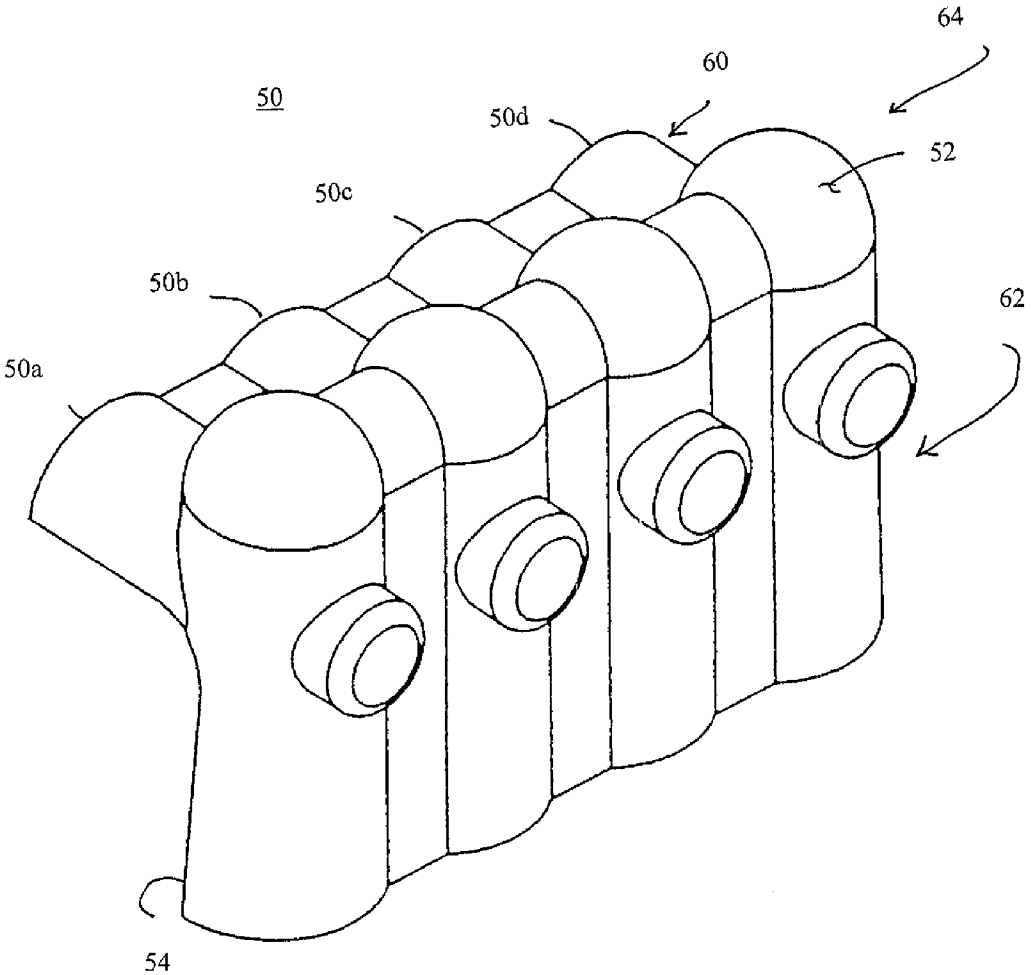
FIG. 3 is a perspective illustration of an embodiment of a loadbreak elbow connector cover in accordance with the present invention

FIG. 3 is a perspective illustration of an elbow cover 50 in accordance with the present invention. Elbow cover 50 includes a plurality of sections as 50*a*, 50*b*, 50*c*, 50*d*. Elbow cover 50 defines an external side 52 and an internal side 54 and a pair of elbow-engaging collar portions 60, 62. A central portion 64 is provided between collar portions 60, 62. Depending on the particular application, central portion 64 may engage elbow 20 or may be offset from contact with elbow 20.

Figure 4:
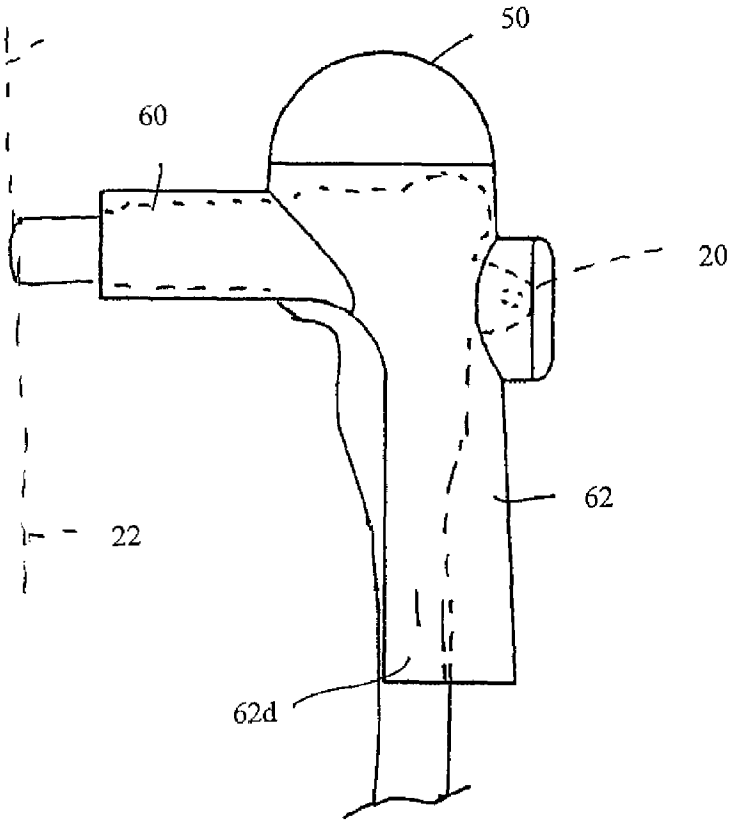
FIG. 4 is a side view of the elbow connector cover of FIG. 3 attached to an elbow connector

FIG. 3 shows the elbow cover 50 prior to be secured over a plurality of elbow connectors 20. In comparison, FIG. 4 is a side view and shows the elbow cover 50 in positive position after being secured over elbow connectors 20. As shown, elbow-engaging collar portions 60, 62 engage corresponding portions of elbow connectors 20.

Figure 5:
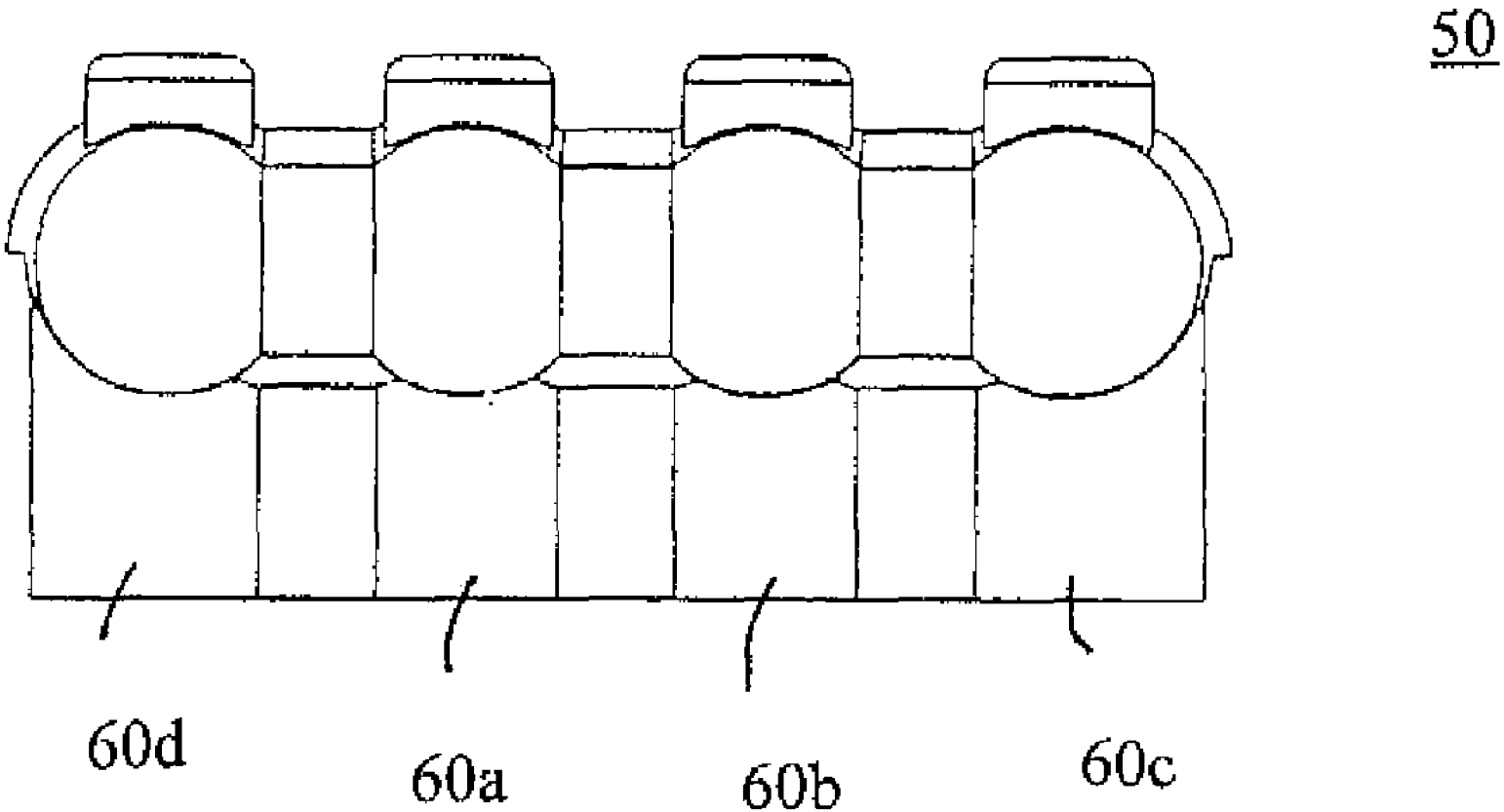
FIG. 5 is a top view of the elbow connector cover of FIG. 3

Referring to FIG. 5, upper collar portions 60 include a pair of inner collar portions, designated 60*a* and 60*b* and a pair of outer collar portions, designated 60*c* and 60*d*. Outer collar portions 60*c* and 60*d* are sized to engage a greater extent of elbow connectors 20.

Figure 6:
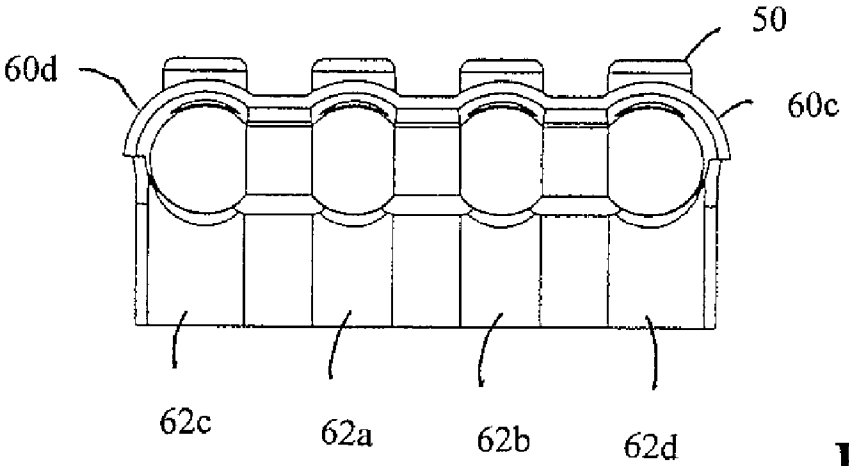
FIG. 6 is another side view of the elbow connector cover of FIG. 3.
Figure 7:
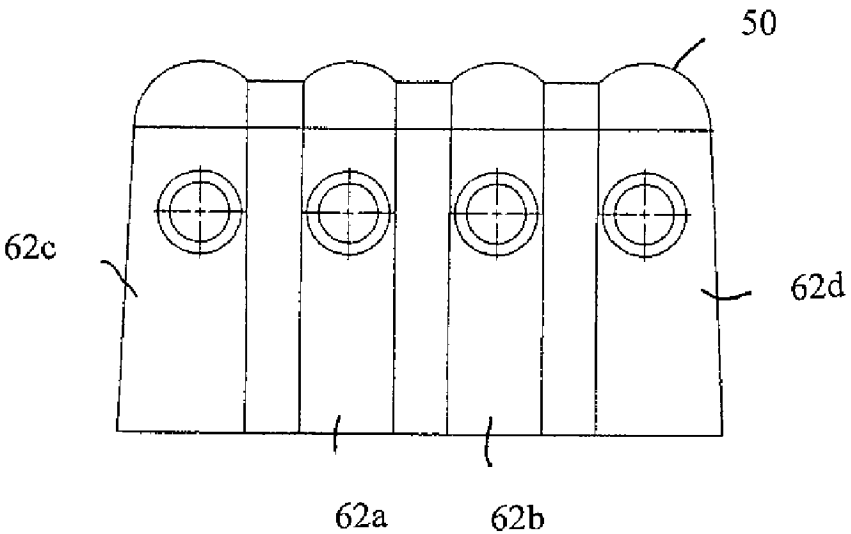
FIG. 7 is another side view of the elbow connector cover of FIG. 3.

Referring to FIGS. 6 and 7, lower collar portions 62 include a pair of inner collar portions, designated 62*a* and 62*b* and a pair of outer collar portions, designated 62*c* and 62*d*. Outer collar portions 62*c* and 62*d* are sized to engage a greater extent of elbow connectors 20. Outer collar portions 62*c* and 62*d* define skirts and are slightly splayed to serve as ramps or cam surfaces that spread apart the resilient cover 50 to accommodate the plurality of elbow connectors 20.

In operation, the inner surfaces of the cover 50 are designed to contact the plurality of elbow connectors 20 as the lineman pushes cover 50 into place. The resiliency and memory of the material forming cover 50 permits the cover to tightly overlie the elbow connectors 20 during repair operations, resulting in a less bulky cover that is positively positioned. The reduced bulk and improved fit of elbow cover 50 gives the lineman an increased work zone.

In use of a preferred embodiment of the present invention, elbow-engaging collar portions 60, 62 are sized to engage a plurality of elbow connectors 20. In a preferred embodiment, collar portions 60, 62 are sufficiently flexible so as to deform against the elbow connectors 20 and be retained against elbow connectors 20 in a form-fitting manner. Collar portions 60, 62, in the preferred embodiment of the present invention are defined by generally semi-circular cross sections. Similarly, collar portions 60, 62 are deformed during a removal process when an external force is used to remove the cover 50 from the plurality of elbow connectors 20.

The material chosen for elbow cover 50 should have low electrical conductivity, low surface porosity (in particular, the surface should be highly hydrophobic) and high physical robustness (including both strength and abrasion resistance). High molecular density polymers are believed to be advantageous. For example, elbow cover 50 may include polyvinyliden fluoride (PDVF), polytetrafluoroethylene (PTFE), fluorinated ethylene-propylene (FEP) and other known materials. A variety of manufacturing techniques such as molding and vacuum forming may be utilized for elbow cover 50. One preferred method is to vacuum form elbow cover 50 from sheet stock.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An insulating cover for a plurality of electrical loadbreak elbow connectors comprising:

an insulative body enshrouding a plurality of elbow connectors secured to a transformer, said body defining a first collar portion secured to a first portion of the plurality of elbow connectors and a second collar portion secured to the plurality of elbow connectors at a second side, with said first collar portion and said second collar portion deflecting into engagement with the plurality elbow of connectors when the cover is placed on the plurality of elbow connectors, with said engagement maintaining the cover in place until an external force is applied to remove the cover.

2. The insulating cover of claim 1 wherein the first collar portion is defined by a plurality of portions having generally semicircular cross-sections.

3. The insulating cover of claim 1 wherein the second collar portion is defined by a plurality of portions having generally semicircular cross-sections.

4. The insulating cover of claim 3 wherein outermost portions of said second collar portion define a pair of skirts.

5. The insulating cover of claim 4 wherein the skirts are splayed outwardly to serve as cam surfaces tending to spread the skirts apart when the cover is forced onto the plurality of elbow connectors.

6. The insulating cover of claim 1 wherein the first collar portion and the second collar portion are separated by approximately 90 degrees.

7. An insulating cover for a plurality of loadbreak elbow connectors comprising:

an insulative body adapted to be deformed into contact with a plurality of loadbreak elbow connectors secured to a transformer, said body including a plurality of collar portions secured against portions of the plurality of loadbreak elbow connectors, said body enshrouding a volume surrounding the plurality of loadbreak elbow connectors with said collar portions defining form-fitting structure adapted to deform into contact with the plurality of loadbreak elbow connectors when an external force is used to place the cover, and said collar portions defining retaining structure adapted to retain the cover in place until an external force is applied to remove the cover from the plurality of loadbreak elbow connectors.

8. The insulating cover of claim 7 wherein one of the plurality of collar portions is defined by a plurality of portions having generally semicircular cross-sections.

9. The insulating cover of claim 8 wherein outermost portions of said plurality of collar portions define a pair of skirts.

10. The insulating cover of claim 9 wherein the skirts are splayed outwardly to serve as cam surfaces tending to spread the skirts apart when the cover is forced onto the plurality of elbow connectors.

11. The insulating cover of claim 7 wherein at least some of the plurality of collar portions are separated by approximately 90 degrees.

12. An apparatus comprising:

a plurality of loadbreak elbow connectors secured to an electrical equipment and coupling a plurality of electrical conductors to said electrical equipment;

an insulative cover adapted to be deformed into contact with the plurality of loadbreak elbow connectors secured to the electrical equipment, said cover including a plurality of collar portions secured against portions of the plurality of loadbreak elbow connectors, said cover enshrouding a volume surrounding the plurality of loadbreak elbow connectors with said collar portions defining form-fitting structure adapted to deform into contact with the plurality of loadbreak elbow connectors when an external force is used to place the cover, and said collar portions defining retaining structure adapted to retain the cover in place until an external force is applied to remove the cover from the plurality of loadbreak elbow connectors.

13. The apparatus of claim 12 wherein one of the plurality of collar portions is defined by a plurality of portions having generally semicircular cross-sections.

14. The apparatus of claim 12 wherein outermost portions of said plurality of collar portion define a pair of skirts.

15. The insulating cover of claim 14 wherein the skirts are splayed outwardly to serve as cam surfaces tending to spread the skirts apart when the cover is forced onto the plurality of elbow connectors.

16. A method of protecting a plurality of elbow connectors secured to electrical equipment, said method including:

providing an insulative body, said body including a plurality of collar portions;

forcing the body against the plurality of elbow connectors, said forcing resulting in securing the body against portions of the plurality of loadbreak elbow connectors with said body enshrouding a volume surrounding the plurality of loadbreak elbow connectors, with said forcing causing collar portions to deform into contact with the plurality of loadbreak elbow connectors, and said forcing generating retaining forces tending to retain the body against the plurality of elbow connectors;

maintaining the body against the plurality of elbow connectors with said retaining forces; and removing the body from the plurality of elbow connectors by application of an external force causing said collar portions to deform away from contact with the plurality of elbow connectors.

17. The method of claim 13 wherein said body includes four generally similar cavities, with at least an outermost pair of said cavities including a skirt structure.

18. The method of claim 17 wherein the skirt structure defines a pair of splayed walls with said splayed walls making contact with a pair of loadbreak elbow connectors.

* * * * *